US006019644A

United States Patent [19]

Kurbikoff et al.

[11] Patent Number: 6,019,644

[45] Date of Patent: Feb. 1, 2000

[54] ELECTRICAL STEP CONNECTOR ASSEMBLY AND METHOD FOR MANUFACTURE

[75] Inventors: Peter A. Kurbikoff, San Diego; Douglas J. Korn, Escondido, both of Calif.

[73] Assignee: Teledyne Industries, Inc., Los Angeles, Calif.

[21] Appl. No.: 08/950,267

[22] Filed: Oct. 14, 1997

[51] Int. Cl.[7] ..... H01R 43/16

[52] U.S. Cl. ..... 439/736; 29/874

[58] Field of Search ..... 29/874, 883, 884; 439/736

[56] References Cited

U.S. PATENT DOCUMENTS

| | | | |
|---|---|---|---|
| 3,215,968 | 11/1965 | Herrmann . | |
| 3,551,750 | 12/1970 | Sterling . | |
| 3,795,884 | 3/1974 | Kotaka . | |
| 3,858,154 | 12/1974 | William . | |
| 3,960,424 | 6/1976 | Weisenburger . | |
| 4,185,882 | 1/1980 | Johnson . | |
| 4,402,562 | 9/1983 | Sado . | |
| 4,445,735 | 5/1984 | Bonnefoy . | |
| 4,521,065 | 6/1985 | Nestor et al. . | |
| 4,738,625 | 4/1988 | Burton et al. . | |
| 4,998,886 | 3/1991 | Werner . | |
| 5,147,207 | 9/1992 | Mowry . | |
| 5,161,982 | 11/1992 | Mowry . | |
| 5,535,513 | 7/1996 | Frantz | 29/882 |
| 5,761,805 | 6/1998 | Guyer | 29/874 |
| 5,822,849 | 10/1998 | Casali et al. | 29/827 |

*Primary Examiner*—Lincoln Donovan
*Attorney, Agent, or Firm*—Nydegger & Associates

[57] ABSTRACT

A step connector assembly for establishing electrical connections between electrical components located at different levels, and a method for manufacturing the step connector assembly. The connector assembly is stepped such that the ends of the connector assembly are at different levels. The components of the assembly include a plurality of electrical connectors, and a plastic body that anchors the connectors and gives structure to the assembly. Each connector is formed with sequentially a base, a knee, and a footing. Due to a bend in the knees of the connectors, the footings are stepped to a different level than the bases of the connectors. The plastic body is formed with a shoulder. To join the connectors with the plastic body, a portion of the plastic body is formed around the base sections of the connectors. After the body is formed around the connectors, the connectors are pulled into the body until abutments on the connectors are embedded into the body, thereby anchoring the connectors into the body. As a result of the pulling of the connectors, the knees of the connectors are located adjacent the shoulder of the body. Further, the knees of the connectors are cantilevered from the body, which allows the connectors to be deflected for easy replacement of components.

14 Claims, 3 Drawing Sheets

ELECTRICAL STEP CONNECTOR ASSEMBLY AND METHOD FOR MANUFACTURE

FIELD OF THE INVENTION

The present invention pertains generally to electrical devices and methods for manufacturing electrical devices. More particularly, the present invention pertains to methods for manufacturing electrical connectors. The present invention is particularly, but not exclusively, useful as an electrical step connector assembly for electrically connecting electrical contacts on a printed circuit board to other electrical components located in a different plane.

BACKGROUND OF THE INVENTION

Electrical systems typically incorporate several electrical components which require reliable electrical interconnections for the proper operation of the system. Oftentimes, entire printed circuit boards must be electrically connected to other components of an electrical device. In such cases, reliable connectors are essential to maintain these electrical pathways between the components and circuit boards.

In the electrical art it may be desirable to locate printed circuit boards in a plane that is different from the plane in which other electrical components are located. For instance, it may be desirable to recess a printed circuit board into a mounting surface. If so, it can happen that the electrical contacts on the mounting surface and the electrical contacts on the circuit board may be located at different levels. Such a configuration requires an electrical connector with the ends of its electrical contacts located in different planes.

Even though the electrical component configuration may be different, in that a step-down or step-up connection is required, the configuration must also satisfy design criteria that are more common. For instance, it is common for even simple electrical systems to require many electrical interconnections. Therefore, there is a need for an electrical connector that includes a plurality of conductive leads for connecting a plurality of contact surfaces. Further, electrical systems in the modern art are frequently designed with the goal that components and circuit boards will be easily removable for replacement or repair. Thus, there is a need for an electrical connector that can easily accommodate repeated removal and replacement of system components and circuit boards without diminishing the overall system performance.

It is widely known in the art that a good solid mechanical connection is required to establish reliable electrical connections. One problem in this regard is that electrical contact surfaces oftentimes acquire a nonconductive coating or film, that must be penetrated to establish reliable electrical connections. This can be done by positioning contact points at the end of cantilevered beams which move slightly during the connecting process. This movement, though slight, will often be sufficient to scratch through the coating and allow for a good electrical connection. An example of such a connector is disclosed in U.S. Pat. No. 5,484,295 which issued to Mowry et al., for an invention entitled, "Low Profile Compression Electrical Connector", and which is assigned to the same assignee as the present invention.

In light of the above, it is an object of the present invention to provide a reliable electrical connector assembly that has a plurality of electrical connectors, with one end of each connector being in one plane, and the other end of each connector being stepped into another plane. Another object of the present invention is to provide an electrical connector assembly that easily accommodates repeated removal and replacement of system components and circuit boards. Another object of the present invention is to provide an electrical connector assembly that establishes solid electrical contact between the assembly and contact points on electrical components. It is another object of the present invention to provide an electrical connector assembly which has contact points that scratch through the film on electrical contacts when the electrical connector assembly is mated with another component, to establish reliable electrical connections. Yet another object of the present invention is to provide an electrical connector assembly which is relatively simple to manufacture, is relatively easy to implement, and is comparatively cost effective.

SUMMARY OF THE INVENTION

The present invention is a step connector assembly for establishing electrical connections between electrical components which have contact points that are located in different planes. The present invention also pertains to a method for manufacturing the step connector assembly.

The step connector assembly of the present invention includes a plurality of elongated electrical connectors and a plastic body that anchors the connectors and gives structure to the assembly. Each connector is formed sequentially with at least three discernible portions along its length. These are a base section, a footing section and a knee which lies therebetween. Specifically, a portion of the base section of each connector is anchored to the plastic body of the connector assembly and the remainder of each connector extends therefrom as a cantilever. The knee of each connector is located at approximately the midpoint of the cantilever, and it respectively establishes about a ninety degree bend in each of the connectors in the assembly. Another bend in each connector is located near the exposed end of each connector. This additional bend is opposite in direction from the bend of the knee, and is provided to angle the footing of each connector about ninety degrees to thereby project the footings outwardly from the body. Due to these oppositely directed bends in the connectors, the footings and the bases are positioned in substantially parallel, but off-set, planes. Thus, most of the cantilever is contoured to generally turn around or over a shoulder at the edge of the plastic body. Stated differently, due to the bend at the knee and the bend next to the footing of each of the connectors, the footings of the connectors are stepped and are located in a different plane than are the bases of the connectors.

As indicated above, the plastic body is formed with a shoulder which is located adjacent the knees of the connectors. The shoulder is defined by a ledge and a bearing wall of the body that join at an angle of approximately 90 degrees. As intended for the present invention, the electrical connectors that are mounted on the body must accommodate the shoulder on the body. More specifically, between the base section and the bend at the knee of each connector, each connector has a lever arm that is angled and rises slightly above the ledge of the body. Also, between the bend at the knee and the bend next to the footing of each connector, each connector has an extension arm which is located adjacent the bearing wall of the body. Importantly, the footing of each connector is located near, and projects outwardly from the bearing wall of the plastic body. Thus, when a connector is mounted on the plastic body, they have a substantially contour fit. Further, due to the cantilever configuration of the connectors, the footings are subject to some movement relative to the bases of the connectors and the plastic body.

In the manufacture of the connector assembly of the present invention, the plurality of connectors are formed and are then positioned with their respective base portions located across the cavity of an injection mold. The mold cavity is then filled with molten plastic by a process such as injection molding. As the plastic hardens in the mold, it forms the plastic body of the assembly and joins the connectors with the plastic body. In this manner, a portion of the plastic body is formed around a portion of the base sections of the connectors.

After the body has been formed around the base sections of the connectors, the connectors are repositioned on the body. To do this, the connectors are pulled until an abutment on each connector is embedded into the body. Specifically, these abutments are located between the base section and the lever arm of the connector. Alternatively, each connector is formed with an edge between the base section and the lever arm, rather than an abutment, and the connectors are pulled until the edge abuts the body. Thus, only the base portion is pulled into the body while the remainder of the body is left exposed. This pulling, then, leaves the knees of the connectors exposed and cantilevered from the body. As indicated above, the footings which extend from the knees also remain exposed and free to move at the end of the cantilevered knees. Importantly, however, as a result of the pulling of the connectors, the knees of the connectors are brought adjacent the shoulder of the body. Consequently, at one end of each connector, a portion of the base section extends from the body to establish an exposed electrical contact area. At the other end of the connectors, an electrical contact point on each of the footings provides another electrical connection for the connector.

As mentioned above, one result of the elasticity of the cantilevered lever arm is that the footings are springably connected to the body. Thus, it happens that when a downward force is applied on the footings, such as when the electrical contacts on an electrical component are pressed against the contact points on the footings, the footings are deflected. This deflectability allows repeated removal and replacement of components from the connector assembly without degradation to the connector assembly or the electrical system. Also, when deflected, the contact points on the footings urge upward and scratch the surface of abutting electrical contacts, thereby enhancing the electrical connection therebetween.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENT

Figure 1:
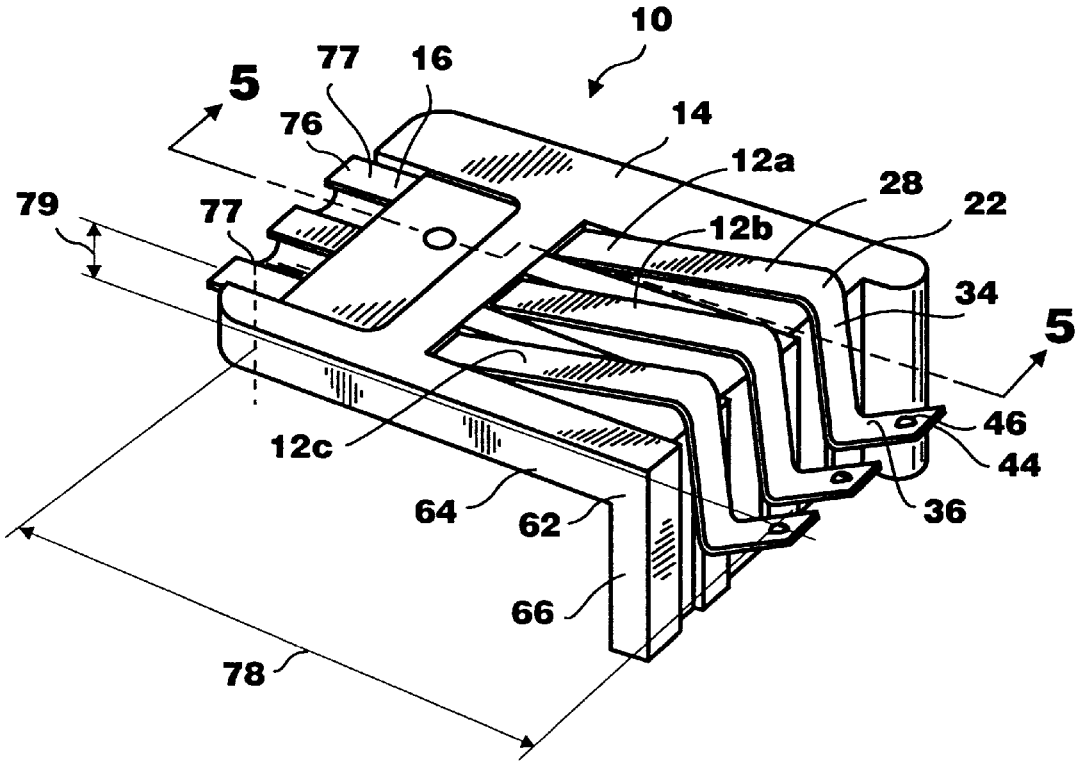
FIG. 1 is a perspective view of an electrical step connector assembly constructed in accordance with the present invention.

Referring to FIG. 1, an electrical step connector assembly constructed in accordance with the present invention is shown and generally designated 10. As shown, the electrical step connector assembly 10 is comprised of a plurality of identical electrical connectors 12*a*, 12*b*, 12*c* which are mounted on a body 14. A portion of the base section 16 of each electrical connector 12*a–c* is surrounded by the body 14, to anchor the electrical connectors 12*a–c* onto the body 14 and to give structure to the step connector assembly 10.

Figure 2:
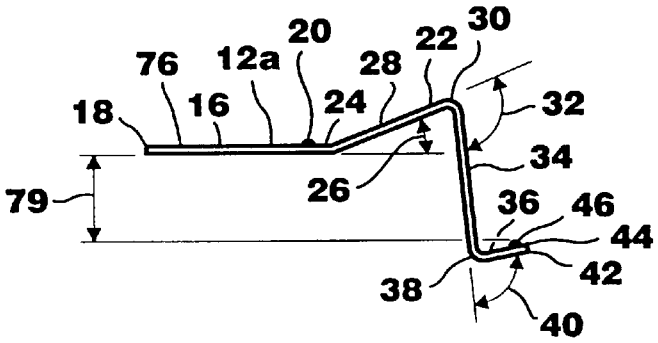
FIG. 2 is a side view of an electrical connector of the present invention, after the base strip has been removed.

Referring now to FIG. 2, the electrical connector 12*a* is shown. This connector 12*a* is representative of each of the substantially identical electrical connectors 12*a–c*. As shown in FIG. 2, it can be seen that electrical connector 12*a* has a base section 16 which extends between a first end 18 and a raised abutment 20. The connector 12*a* also has a knee 22 and a lever arm 28 which is located between the abutment 20 and the knee 22. As shown, the lever arm 28 has a slight bend 24 with an angle 26 of about twenty degrees (20°) which angles the lever arm 28 relative to the base section 16. A bend 30 in each knee 22, the bend 30 having an angle 32 which is about ninety degrees (90°) or more, causes an extension arm 34 to angle from the lever arm 28. As seen in FIG. 2, this extension arm 34 is located between the bend 30 of knee 22 and a bend 38. As a result of the bend 38 a footing 36 is formed adjacent the extension arm 34. More specifically, the bend 38 is at an angle 40 of about ninety degrees (90°) and is opposite in direction from the bend 30. Thus, it causes the footing 36 of each electrical connector 12*a–c* to extend from the extension arm 34 and the knee 22. Each electrical connector 12*a–c* has a second end 42 at the end of the footing 36.

To create an area for making an electrical connection on each footing 36, each footing 36 is formed with an electrical contact point 44 which is shaped with a substantially hemispherical or conical projection 46. It can be seen that each contact point 44 is stepped from each base section 16. In the preferred embodiments of the connector assembly 10, the electrical connectors 12*a–c* are made of about 0.010 inch thick copper alloy with tin plating, or of about 0.008 inch thick copper alloy with gold plating. It will be appreciated by the skilled artisan that other electrically conductive materials can also be used.

Figure 3:
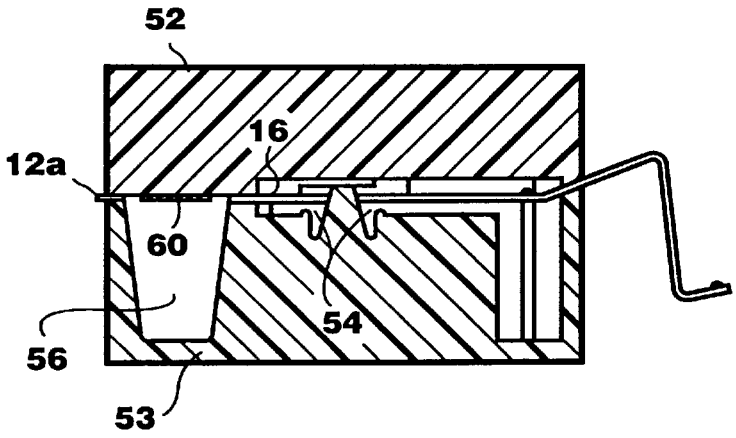
FIG. 3 is a depiction of a cross-sectional view of the injection molds, with an electrical connector of the present invention placed between the molds, prior to the injection of plastic into the molds to form the body.

After the electrical connectors 12*a–c* have been formed, the body 14 is formed around a portion of the base section 16 of each electrical connector 12*a–c*, through the process of injection molding. Referring now to FIG. 3, electrical connector 12*a*, can be seen positioned between a top injection mold 52 and a bottom injection mold 53. As shown, when the injection molds 52, 53 are juxtaposed, they create a main cavity 54 and a base bar cavity 56. As also shown, a portion of the base section 16 of each electrical connector 12*a–c* is placed into the main cavity 54. It will be appreciated that the main cavity 54 has the shape of the body 14.

Once the connectors 12*a–c* are positioned between the molds 52, 53, a molten material, such as plastic, is then injected into the cavities 54, 56. The injected material then surrounds a portion of the base section 16 of each electrical connector 12*a–c*. In the preferred embodiment, the body 14 is made of about thirty percent glass filled black thermoplastic, although it will be appreciated by the skilled artisan that other moldable material can also be used. After the plastic is injected into the main cavity 54 and the base bar cavity 56, the plastic hardens, thereby joining the electrical connectors 12*a–c* with the plastic body 14.

Figure 4:
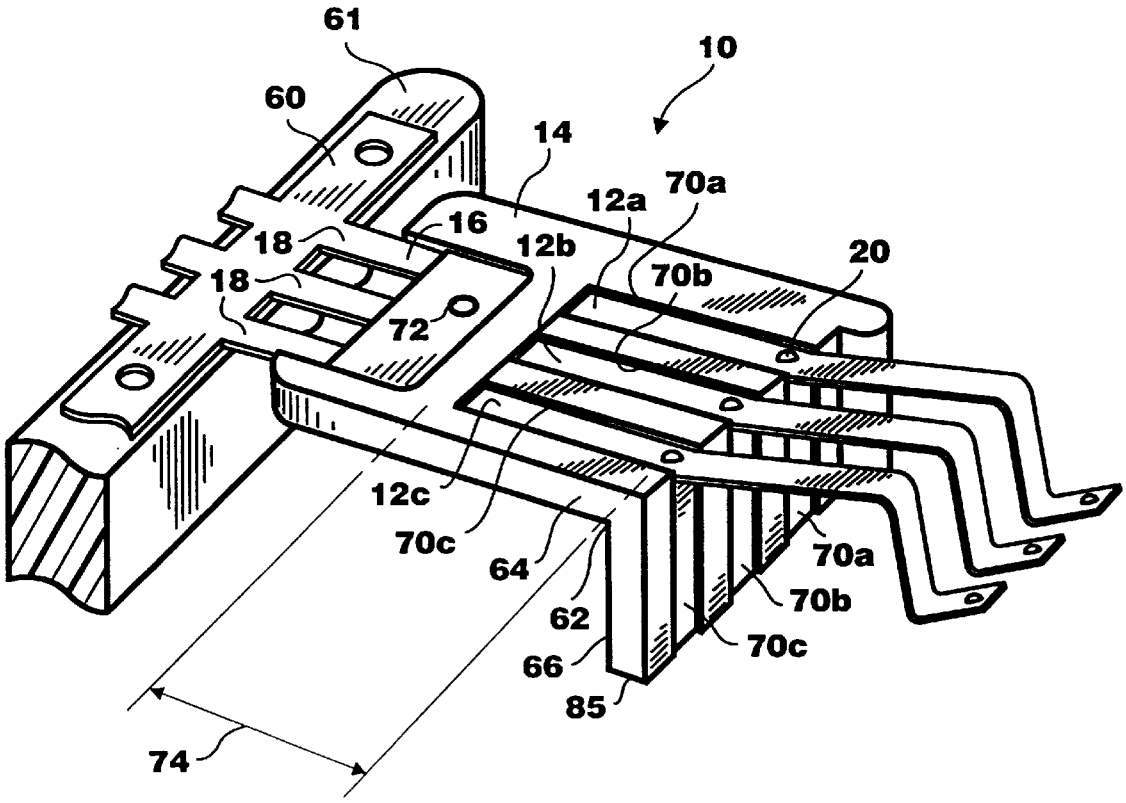
FIG. 4 is a perspective view of an electrical step connector assembly constructed in accordance with the present invention, prior to the step of repositioning the connectors in the body.

Referring now to FIG. 4, a partially completed step connector assembly 10 is shown after the body 14 has been formed around a portion of the base section 16 of each electrical connector 12*a–c*. It can be seen that the first ends 18 of the electrical connectors 12*a–c* are connected to each other by a base strip 60 which holds the electrical connectors 12*a–c* in position before the body 14 is formed around them. It will be appreciated by the skilled artisan that the process of manufacturing the step connector assembly 10 is simplified by forming the base strip 60 out of a continuation of the same material that the electrical connectors 12*a–c* are made out of. A base bar 61 can be seen below the base strip 60.

Still referring to FIG. 4, it can be seen that the body 14 is formed to have a shoulder 62. Specifically, the shoulder 62 is defined by a ledge 64 and a bearing wall 66. As shown, the ledge 64 and bearing wall 66 are formed with guide grooves 70*a*, 70*b*, 70*c* for maintaining the separation between the respective electrical connectors 12*a–c*. The body 14 is also formed with a hole 72 through the ledge 64 near the base sections 16. It will be appreciated by the skilled artisan that the hole 72 can be used for threading wires, for example motor magnet wires, through the step connector assembly 10.

Figure 7:
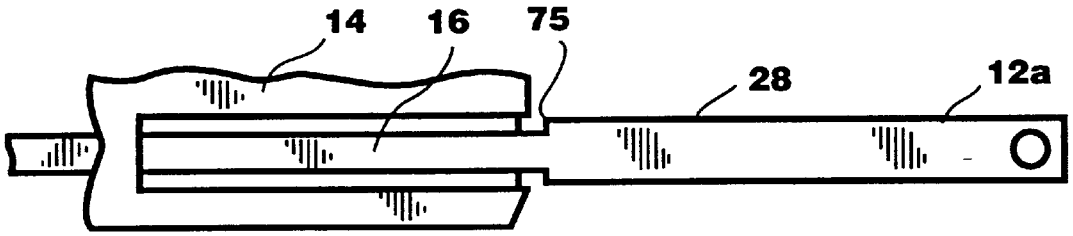
FIG. 7 is a top cutaway view of part of the body, and part of an electrical connector having an edge, of the present invention.

After the body 14 has been formed around a portion of the base section 16 of each electrical connector 12*a–c* and the step connector assembly 10 has been removed from the molds 52, 53, the electrical connectors 12*a–c* are pulled from a first configuration as can be seen in FIG. 4, to reposition the electrical connectors 12*a–c* in desired locations relative to the body 14. This repositioning then establishes the connector assembly 10 in a second configuration as shown in FIG. 1. Specifically, the electrical connectors 12*a–c* are pulled through a distance 74, which results in the respective abutment 20 of each electrical connector 12*a–c* being embedded in the body 14. The effect of this is to anchor the electrical connectors 12*a–c* in the body 14. Alternatively, rather than having an abutment 20, each electrical connector 12*a–c* is formed with an edge 75 between the base section 16 and the lever arm 28, as shown in FIG. 7. In this alternative embodiment, each electrical connector 12*a–c* is pulled until the edge 75 abuts the body 14.

After the connectors 12*a–c* have been pulled relative to body 14, each electrical connector 12*a–c* is cut at the first end 18 adjacent the base strip 60. This removes the base strip 60 and the base bar 61 from the step connector assembly 10. It will be appreciated by the skilled artisan that cutting the electrical connectors 12*a–c* separates the electrical connectors 12*a–c* from each other. The connectors 12*a–c*, however, are held in juxtaposition by the electrically nonconductive plastic body 14. Consequently, the electrical connectors 12*a–c* are electrically isolated from each other. The skilled artisan will further appreciate that a plurality of step connector assemblies 10 may be simultaneously manufactured with the method of the present invention, by locating additional electrical connectors 12*a–c* in groups along the base strip 60.

Referring again to FIG. 1, it can be seen that after the electrical connectors 12*a–c* have been pulled and thereby relocated in the body 14, each portion of the electrical connectors 12*a–c* is precisely located in relation to the body 14. The knees 22 of the electrical connectors 12*a–c* are located adjacent the shoulder 62 of the body 14. More specifically, the extension arms 34 are located adjacent the bearing wall 66 of the body 14, and the lever arms 28 are located proximate the ledge 64 of the body 14. Additionally, a portion of each base section 16 extends from the body 14 to establish an exposed electrical contact area 76, also referred to as a pad, on each base section 16. Therefore, the electrical contact area 76 on each base section 16, and the electrical contact point 44 on each footing 36, are located close to the body 14. Further, it can be seen that a center 77 of the electrical contact area 76 on each base section 16 is separated from the respective projection 46 of the electrical contact point 44 on each footing 36. This separation is characterized, and can be measured by two mutually perpendicular distances. These are the distance 78 and the distance 79 as shown in FIG. 1.

Figure 5:
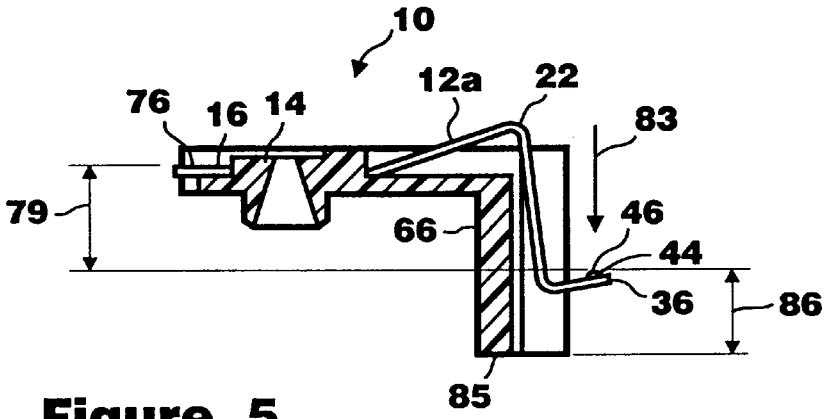
FIG. 5 is a cross-sectional view of an electrical step connector assembly constructed in accordance with the present invention as seen along the line 5—5 in FIG. 1.
Figure 6:
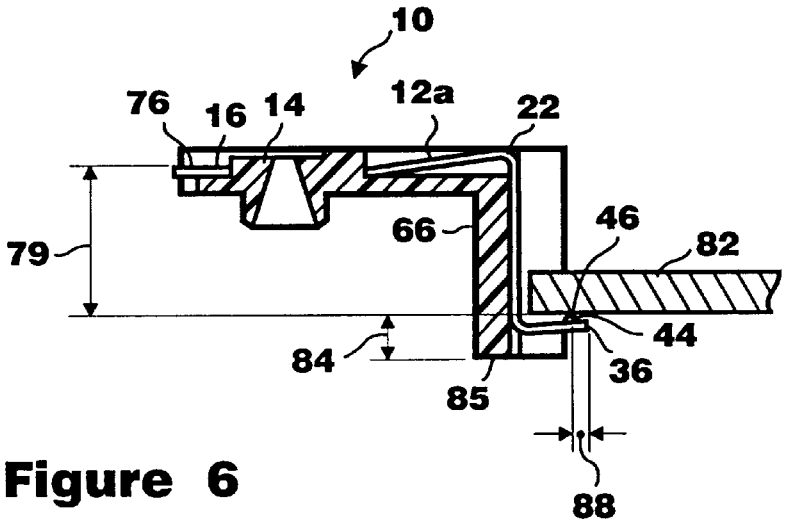
FIG. 6 is a cross-sectional view of an electrical step connector assembly constructed in accordance with the present invention as shown in FIG. 5, with the connectors deflected by a circuit board.

Referring now to FIG. 5, it can be seen that electrical connector 12*a* is positioned on the body 14 such that knee 22 is cantilevered from the body 14. Due to the elasticity of the electrical connectors 12*a–c*, the electrical connectors 12*a–c* are generally deflectable when a force is applied against the footings 36. Typically, this force will be applied whenever a circuit board 82 is pressed against the footings 36 as shown in FIG. 6. The direction of this applied force will generally be as indicated by the arrow 83 in FIG. 5 and will be generally parallel to the bearing wall 66. In FIG. 6, a distance 84, which is measured along bearing wall 66 in the direction indicated by arrow 83, results when the footings 36 have been pushed downward by the circuit board 82.

When the circuit board 82 is pressed against the footings 36, the projections 46 of the footings 36 are deflected towards a bottom end 85 of the bearing wall 66. This deflection typically moves the projections 46 through a distance which has components both perpendicular and parallel to the bearing wall 66. Thus, during the deflection of footing 36, the projections 46 wipe across the corresponding connectors on circuit board 82. It happens that when the projections 46 are deflected to the configuration shown in FIG. 6, the projections 46 urge in a direction opposite arrow 83. The projections 46 urge in a direction opposite arrow 83 with a minimum force of about one hundred fifty grams (150 grams) for the embodiment with tin plating on the electrical connectors 12*a–c*, and with a minimum force of about eighty grams (80 grams) for the embodiment with gold plating. This urging, together with the wiping action of the projections 46 against circuit board 82, enhances the electrical connections between the projections 46 and the circuit board 82.

A more complete appreciation of the electrical connection between the electrical connectors 12*a–c* and circuit board 82 can be had by comparing FIG. 5 with FIG. 6. There it can be seen that when the circuit board 82 is pressed against the footings 36, the footings 36 move towards the bearing wall 66, in addition to moving generally in the direction of the arrow 83. This movement towards the bearing wall 66 causes the projections 46 of the contact points 44 to wipe across the circuit board 82. In FIG. 5, projection 46 can be seen to be a distance 86 from the bottom end 85. In contrast, as shown in FIG. 6, the projections 46 are typically deflected to the distance 84 of about fifty thousandths of an inch (0.050 inch) from the bottom end 85. When the projections 46 are deflected from the configuration shown in FIG. 5, to the configuration shown in FIG. 6, the projections 46 move a distance 88 of a minimum of about seven thousandths of an inch (0.007 inch) towards the bearing wall 66. This wiping movement of the projections 46, causes the projections 46 to scratch through nonconductive film that may be on the circuit board 82, thereby enhancing the electrical connection therebetween.

While a particular electrical step connector assembly and a method for manufacturing an electrical step connector assembly as herein shown and disclosed in detail are fully capable of obtaining the objects and providing the advantages herein before stated, it is to be understood that they are merely illustrative of the presently preferred embodiments of the invention and that no limitations are intended to the details of construction or design herein shown other than as described in the appended claims.

What is claimed is:

1. A method for manufacturing a step connector assembly which comprises the steps of:

forming an electrical connector, said electrical connector having a first end and a second end and having sequentially therebetween a base section, a lever arm, an extension arm, and a footing, said extension arm being angled from said lever arm to step said footing from said base section;

surrounding a portion of said base section with a body, said body being formed with a shoulder defined by a ledge and a bearing wall; and pulling said electrical connector through said body to brace said base section in said body, to cantilever said lever arm from said ledge, and to juxtapose said extension arm adjacent said bearing wall with said footing extending outwardly from said bearing wall for deflection of said footing along said bearing wall in response to a bending of said lever arm.

2. A method as recited in claim 1 wherein said electrical connector is formed with a raised abutment, said abutment being located between said base section and said lever arm, and wherein said pulling step is completed when said raised abutment is imbedded into said body.

3. A method as recited in claim 1 wherein said electrical connector is formed with an edge, said edge being located between said base section and said lever arm, and wherein said pulling step is completed when said edge abuts said body.

4. A method as recited in claim 1 wherein said base section extends from said body after said pulling step to establish an exposed electrical contact area on said base section, and wherein said footing is formed with an electrical contact point having a projection.

5. A method as recited in claim 2 wherein said electrical connector is formed with a first bend located between said abutment and said lever arm to incline said lever arm relative to said ledge, said incline being at an angle of approximately twenty degrees (20°); and wherein said electrical connector is formed with a second bend between said lever arm and said extension arm, to step said footing from said base section and to position said extension arm adjacent said bearing wall; and further, wherein said electrical connector is formed with a third bend between said extension arm and said footing, to extend said footing away from said bearing wall.

6. A method as recited in claim 4 wherein said bearing wall has a bottom end, and wherein said projection moves toward said bearing wall a minimum of about seven thousandths of an inch (0.007 inch) when said projection is deflected to a distance of about fifty thousandths of an inch (0.050 inch) from said bottom end of said bearing wall.

7. A method as recited in claim 1 wherein said step connector assembly includes a plurality of said electrical connectors.

8. A method as recited in claim 7 wherein said ledge and said bearing wall are formed with guide grooves beneath each said electrical connector, for maintaining the separation between said electrical connectors.

9. A method as recited in claim 7 further comprising the steps of:

connecting a base strip between said first ends of said electrical connectors, prior to said surrounding step, for holding said electrical connectors in fixed positions; and cutting said electrical connectors at said first ends adjacent said base strip, after said pulling step, to remove said base strip from said electrical connectors and to electrically separate said electrical connectors from each other.

10. A method as recited in claim 1 further comprising the step of placing a portion of said base section of said electrical connector inside a cavity formed between injection molds; and wherein said surrounding step is accomplished by filling said cavity with moldable material to form said body onto said connector and establish said assembly in a first configuration.

11. A method as recited in claim 10 wherein said pulling step moves said electrical connector from said first configuration to a second configuration wherein said lever arm is located adjacent said ledge to juxtapose said extension arm adjacent said bearing wall and to brace said base section in said body.

12. A method as recited in claim 1 wherein said surrounding step is accomplished by injection molding, and wherein said body is made of about thirty percent glass filled thermoplastic.

13. A method as recited in claim 1 wherein said electrical connector is made of about 0.010 inch thick copper alloy, with tin plating.

14. A method as recited in claim 1 wherein said electrical connector is made of about 0.008 inch thick copper alloy, with gold plating.

* * * * *